US005092581A

United States Patent [19]

Koz

[11] Patent Number: 5,092,581

[45] Date of Patent: Mar. 3, 1992

[54] ROWING EXERCISE APPARATUS

[76] Inventor: Michael Koz, 31 McMann Dr., Thorold, Ontario, Canada, L2V 2V5

[21] Appl. No.: 546,754

[22] Filed: Jul. 2, 1990

[51] Int. Cl.[5] ..... A63B 69/06

[52] U.S. Cl. ..... 272/72; 272/129; 434/247

[58] Field of Search ..... 272/72, 73, 129, DIG. 4; 434/247, 255, 392; 128/25 R; 73/379; 440/105; 114/363

[56] References Cited

U.S. PATENT DOCUMENTS

| | | | |
|---|---|---|---|
| 199,432 | 1/1878 | Goldie | 272/72 |
| 1,504,375 | 8/1924 | Phillips | 272/72 |
| 2,455,548 | 12/1948 | Bell | 272/79 |
| 4,378,111 | 3/1983 | Tsuchida et al. | 272/73 |
| 4,687,197 | 8/1987 | Larson | 272/72 |
| 4,700,962 | 10/1987 | Salmon | 280/220 |
| 4,743,011 | 5/1988 | Coffey | 272/72 |
| 4,746,112 | 5/1988 | Fayal | 272/72 |
| 4,756,523 | 7/1988 | Rasmussen | 272/72 |
| 4,768,776 | 9/1988 | Giannotti | 272/72 |
| 4,772,013 | 9/1988 | Tarlow, Jr. | 272/72 |
| 4,795,147 | 1/1989 | Seal | 272/72 |
| 4,889,509 | 12/1989 | Pohlus | 272/72 X |
| 4,984,986 | 1/1991 | Vohnorut | 272/72 X |

FOREIGN PATENT DOCUMENTS

| | | | |
|---|---|---|---|
| 0825121 | 4/1981 | U.S.S.R. | 272/72 |

*Primary Examiner*—Richard J. Apley
*Assistant Examiner*—Joe H. Cheng
*Attorney, Agent, or Firm*—Wallace F. Neyerlin

[57] ABSTRACT

A rowing exercise apparatus is capable of emulating the actual sensations of rowing, including the sensation of tippiness at slow rowing speeds and also providing an artificially induced sense of motion to the rower of the apparatus at the end of each rowing stroke. The energy put forth by the rower by pulling the oars is transmitted to the gyroscopic flywheel by a system of belt and pulleys operatively connected between the oars and the flywheel for the purpose of creating and maintaining stability of the rower's seat, which then simulate the action or feeling of a rower in a shell gliding in water. The rowing exercise apparatus is capable of lending itself to group participating exercise by means of coupling two or more machines, end to end, in a horizontal plane.

10 Claims, 8 Drawing Sheets

ROWING EXERCISE APPARATUS

BACKGROUND OF THE INVENTION

1. Field of the Invention

This invention relates to a rowing machine exercise apparatus which emulates the actual sensations of rowing or sculling, including the sensation of "tippiness" at slow rowing speeds, and also provides an artificially induced sense of motion of the frame of the apparatus at the end of each stroke.

2. Description of the Prior Art

Exercising equipment such as rowing machines is well-known and frequently used in private and commercial circumstances. Rowing machines allow the user to exercise his arms, shoulders, chest and legs by simulating the movement required to propel a rowboat. However, no rowing exercise apparatus is believed known that while being used by the exerciser emulates the sensation of "tippiness" at slow rowing speeds, nor which induces an artificial sense of motion of the frame of the apparatus at the end of each stroke.

The following patents were located in a novelty search carried out on the ideas of the present invention:

| U.S. Pat. No. | Issued | Inventor |
|---|---|---|
| 199,432 | January 22, 1878 | G. Goldie |
| 2,455,548 | December 7, 1948 | J. D. Bell |
| 4,687,197 | August 18, 1987 | Larsson et al |
| 4,700,962 | October 20, 1987 | Salmon |
| 4,743,011 | May 10, 1988 | Coffey |
| 4,746,112 | May 24, 1988 | Fayal |
| 4,756,523 | July 12, 1988 | Rasmussen |
| 4,768,776 | September 6, 1988 | Giannotti |
| 4,772,013 | September 20, 1988 | Tarlow, Jr. |
| 4,795,147 | January 3, 1989 | Seal |

U.S. Pat. No. 199,432 to Goldie relates to a rowing-machine, comprising two gunwale pieces A—A framed into segmental rockers DD, fitted with teeth and located on rollsurfaces f—f. An oar is provided at one end thereof, for mounting within friction slides. Unlike important features possessed by the apparatus of the present invention, no flywheel is disclosed for gyroscopic stabilization, nor is the frame longitudinally slidable.

U.S. Pat. No. 4,746,112, 2,455,548 and 4,772,013 each relate to rowing machines (in the case of U.S. Pat. No. 2,455,548 a pedal machine), and each have a vertically oriented flywheel. Unlike the present invention, however, none of the patents disclose a laterally pivotable frame nor teach making use of the inherent gyroscopic tendencies of the flywheels for the purposes of stabilizing the machine.

U.S. Pat. No. 4,743,011 discloses a horizontally oriented flywheel 72, which is activated by movement of rower arms 36. Unlike the present invention, however, the frame is not laterally pivotable or rollable, nor is the flywheel adapted to gyroscopically stabilize the frame. Although a slidable seat 27 is disclosed, no additional longitudinally slidable frame, operativly connected to the flywheel so as to cause displacement of the flywheel from a spinning axis, is either taught or disclosed.

U.S. Pat. No. 4,700,962 to Salmon does disclose a rowing type vehicle, utilizing wheels 22 which when rotated could be said to gyroscopically stabilize the frame 10. However, the primary function for the wheel 22 is for rollable transport, and cannot serve to gyroscopically stabilize the frame when stationary, as the flywheel in the present invention does.

U.S. Pat. No. 4,756,523 to Rasmussen, 4,687,187 to Larsson, 4,795,147 to Seal, and 4,768,776 to Giannoti each disclose rowing machines having slidable seats. None disclose use of a flywheel device for gyroscopic stabilization.

Also, none of these patents, either singly or in combination with any of the others, teaches or suggests a rowing exercise apparatus that while being used by the exerciser emulates the sensation of "tippiness" at slow rowing speeds; nor which induces or emulates an artificial sense of motion of the frame of the apparatus at the end of each stroke.

SUMMARY OF THE INVENTION

The foregoing described emulated sensations made possible by the present invention are based upon the inclusion in the rowing apparatus of the following main members:

1. a horizontal and vertical structural support frame:
2. A gyroscopic member for rotation in a portion of said support frame; and
3. a laterally pivotable platform supported by the structural support frame, operatively connected to the gyroscopic member and capable of being gyroscopically stabilized thereby, and a floating assembly platform also being longitudinally slidable atop the structural support frame.

OBJECTS OF THE INVENTION

Accordingly, it is a principal object of the invention to provide a rowing machine exercise apparatus which emulates the actual sensations of rowing or sculling, including the sensation of "tippiness" at slow rowing speeds and which also provides an artificially induced sense of motion of the apparatus at the end of each stroke.

It is another object of the invention to accomplish the foregoing object by providing an apparatus which is novel and unique in structure and capable of serving several other purposes besides merely providing an exercise apparatus for a lone individual who uses same.

It is another object of the invention to provide a rowing exercise apparatus which is capable of lending itself to group participating exercise by means of coupling two or more machines, end to end, in a horizontal plane.

It is another object of the invention to provide a rowing exercise apparatus capable of being used individually in competition with one or more other devices of the same construction in order to provide a competition type of exercise, by means of which with ergomatic totalling type of apparatus on each machine, the capability of each of the individuals operating the various devices can be assessed.

It is another object of the invention to provide a rowing exercise apparatus that can be designed and the components so arranged, within the scope of the invention, as to be usable for three main purposes and/or by three main different categories of people using same: viz.

a. general, non-professional people (the public) looking for exercise;
b. amateur and professional people in the sport fraternity; and
c. for medical, clinical, health and analytical testing use.

These and other objects will be made clearer when considering the following detailed specification taken in conjunction with the appended drawing figures.

BRIEF DESCRIPTION OF THE DRAWING FIGURES

Referring now to the attached drawings, wherein like reference numerals refer to like elements throughout the various drawing figures.

Figure 2:
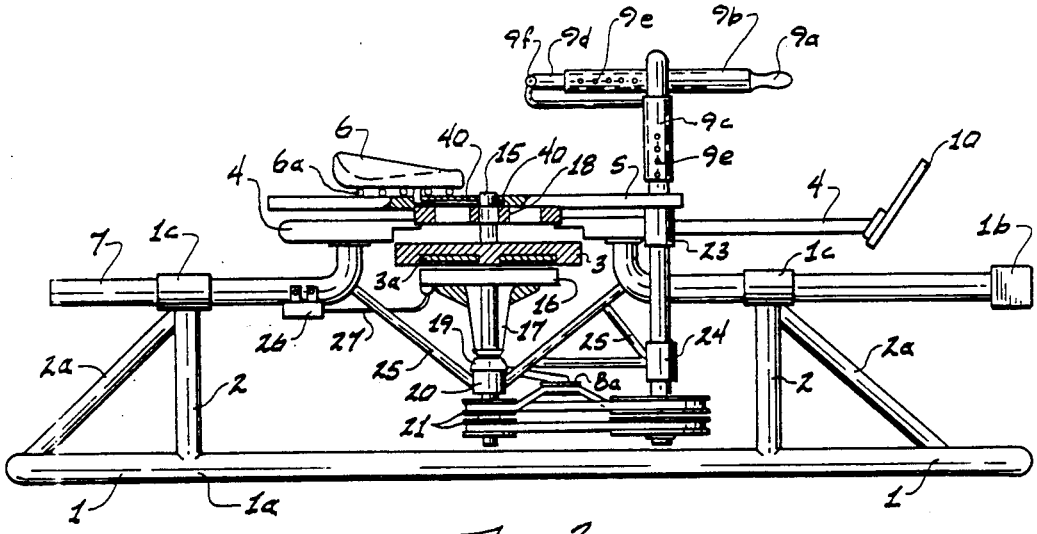
FIG. 2 is a vertical sectional side view of the exercise device of FIG. 1.
Figure 6:
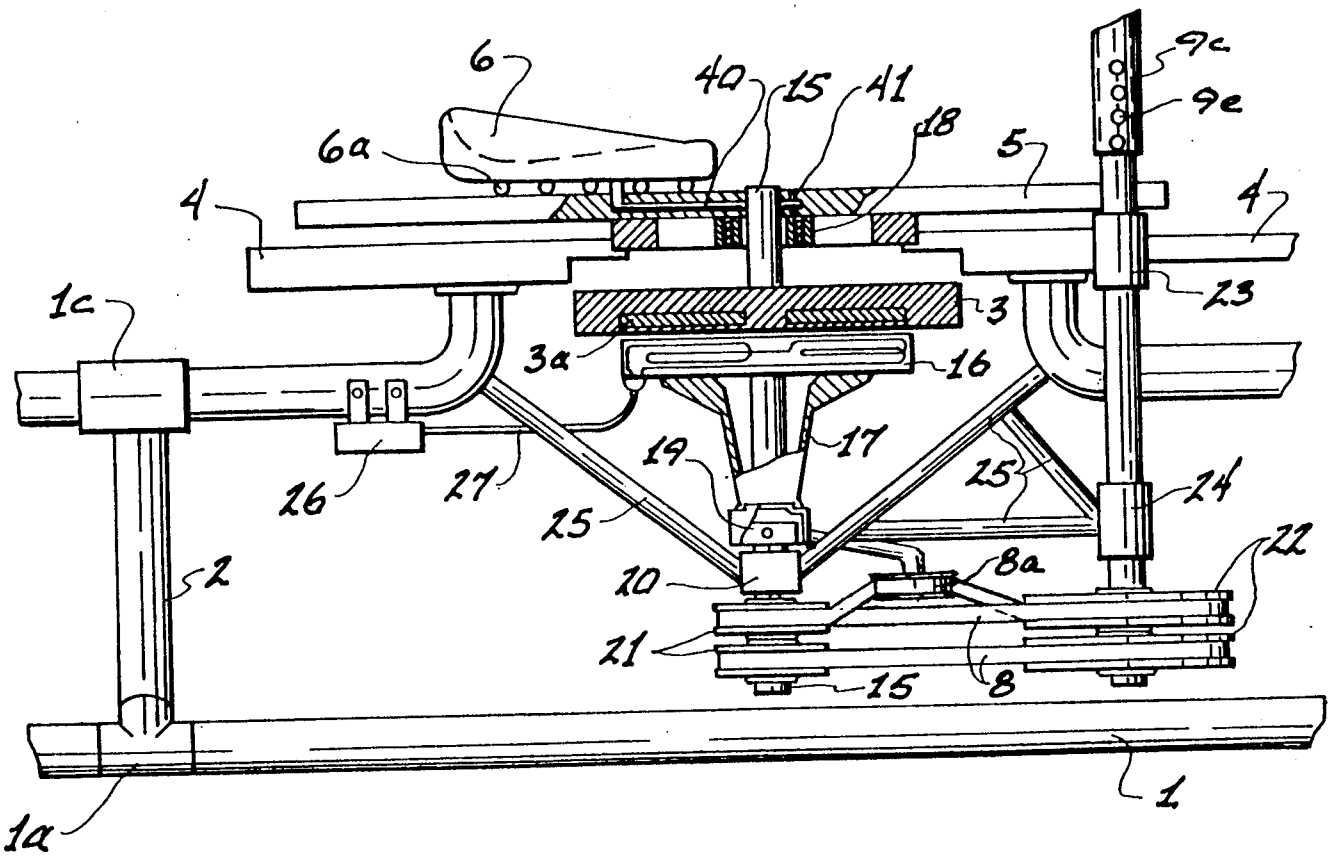
Figure 8:
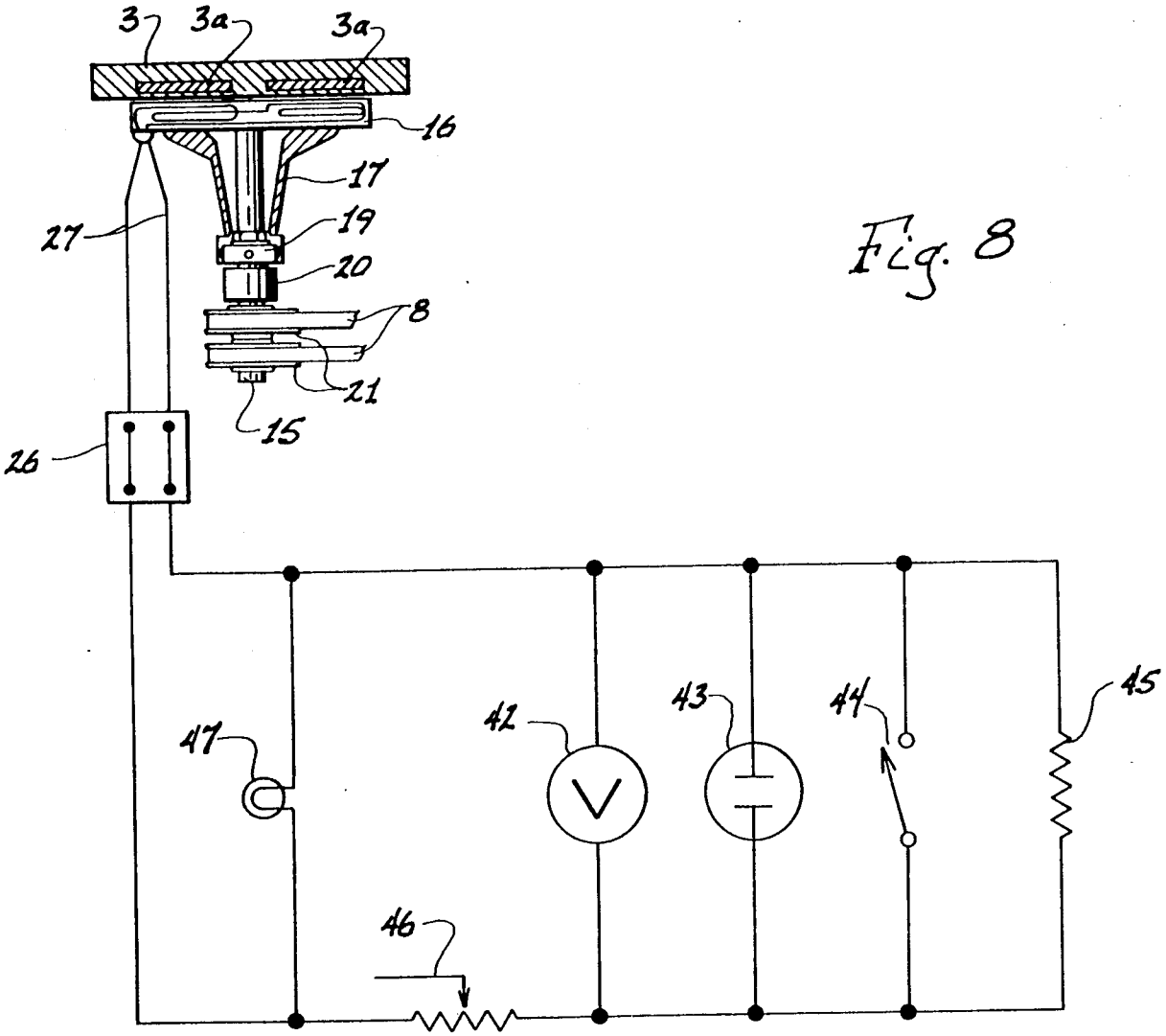

FIG. 6 is an enlarged vertical sectional side view of a portion of the apparatus illustrated in FIG. 2, with an additional modification shown thereon as to how the apparatus can be utilized in order to assist in assessing the capability of the individual operating the device and/or in helping to assess the operating individual's medical or health condition by virtue of magnetic pickup between the flywheel and a voltage coil;

FIGS. *7a, b* and *c* are included to illustrate how the angular position of the flywheel varies or may vary during the operation of the device; and in order to assist in describing the interaction of the universal joint, the thrust bearing and the pulleys and V-belts that are utilized in the operation of the device; and to show the body motion of the rower on the seat and position of the gyroscope with respect to the user's body motion;

FIG. 8 is a schematic view of associated electrical circuitry and components thereof that may be used for the purposes referred to in reference to FIG. 6 including a small scale repetition of what is shown in FIG. 6.

Figure 1:
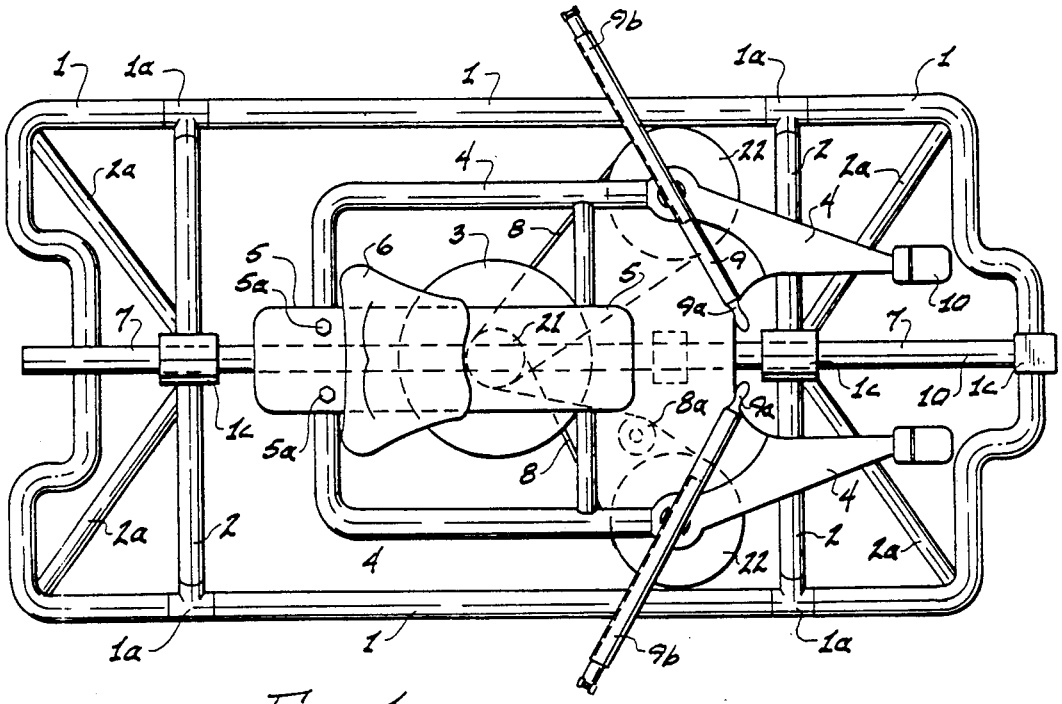
FIG. 1 is a top plan view of the exercise device; (in this embodiment of the invention, oars are employed by the user to provide the propulsion)
Figure 9:
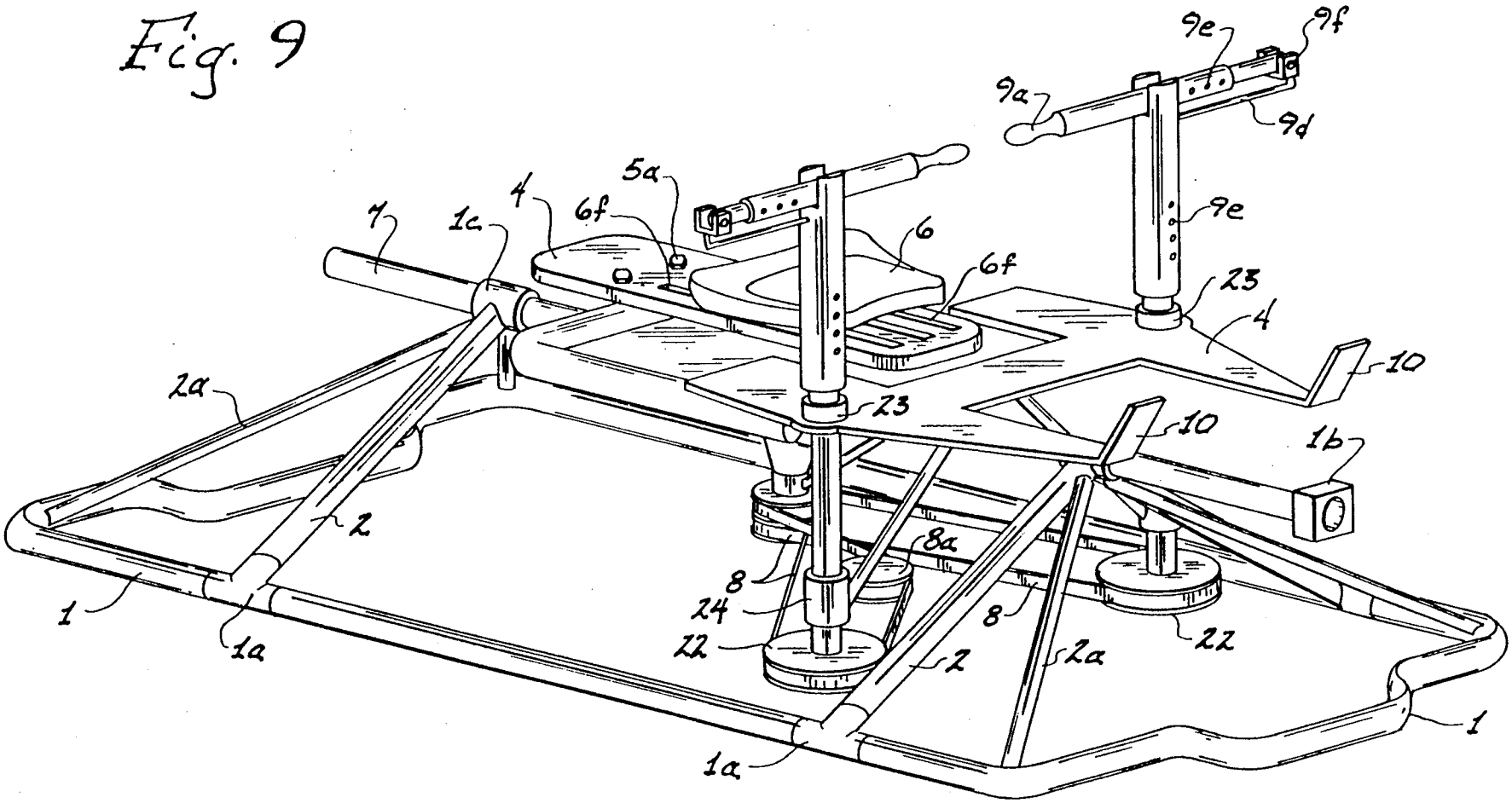
Figure 10:
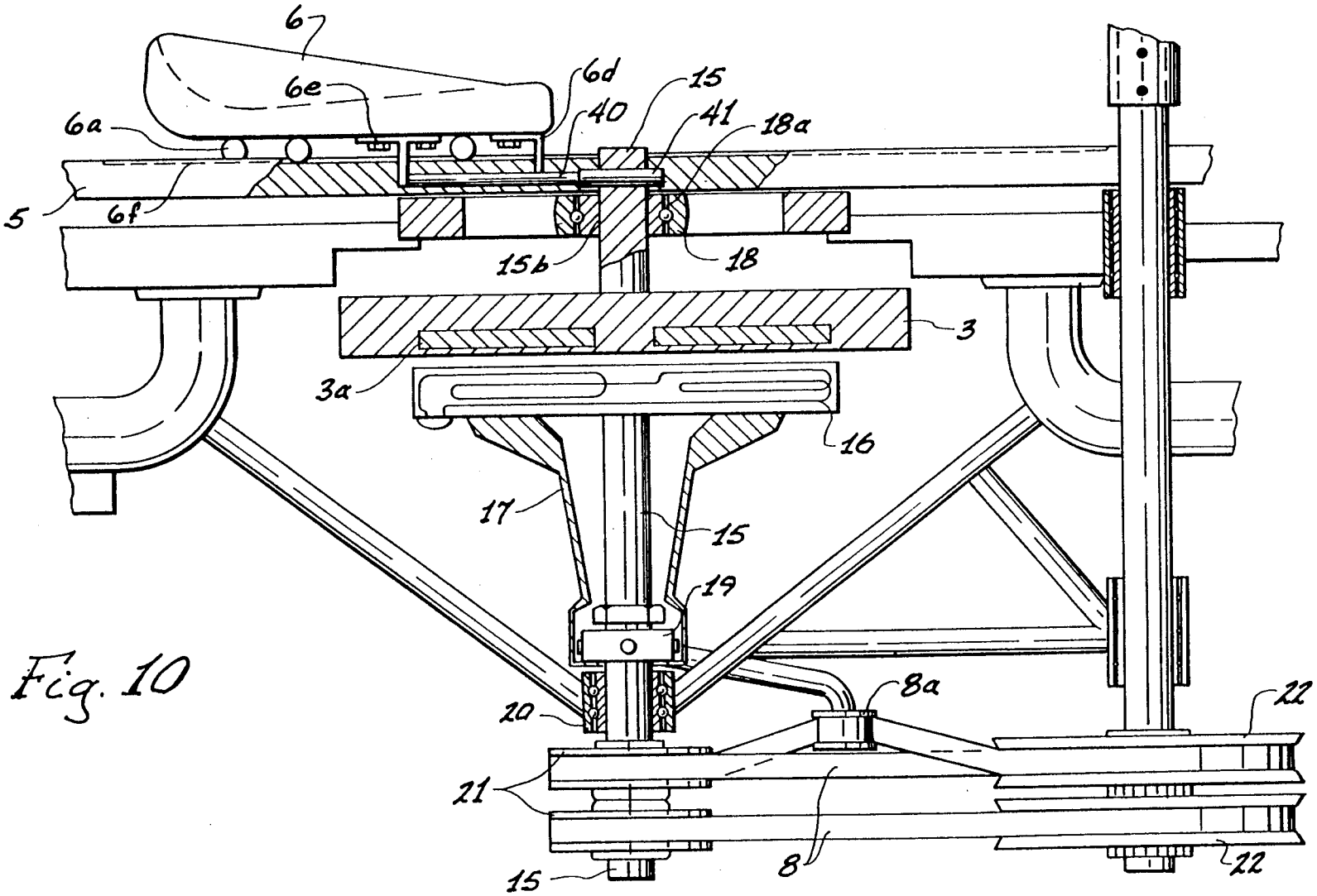

FIG. 9 is a three-dimensional perspective view of the exercise device of FIG. 1; and FIG. 10 is an enlarged vertical sectional side view of a portion of the apparatus and is included to particularly illustrate a preferred structural arrangement and interaction between the seat, the floating assembly and a bearing for the shaft of the flywheel.

DETAILED DESCRIPTION OF THE DRAWINGS AND OF THE PREFERRED EMBODIMENTS

As previously stated, FIG. 1 shows a top plan view of the exercise device. As shown, the device is comprised of several components, including horizontal bottom sections 1 of the structural support frame. These sections 1 of the support frame form a substantially rectangular shape with the longer dimension being along the axis of the device. The support frame also has structural angular pillar support members 2 extending in a generally vertical direction cross-wise of the device and slanted or diagonal brace members 2*a* for supporting pillar bushings 1*c* through which cylindrically shaped shaft 7 slides back and forth. Couplings 1*a* are employed to connect the horizontal frame members 1 to the generally vertical but angular frame members 2 (i.e. see FIG. 3 for further depiction). The structural support frame supports a floating platform 4, which platform in turn supports a floating assembly platform 5 which slides longitudinally back and forth atop the floating platform 4; i.e. both members slide back and forth together since they are coupled together by attachment means such as by nuts and bolts depicted at 5*a*. The floating platform 4 is able to slide back and forth because it is supported on but freely movable in the axis direction of the device by rod member 7 which is circular in cross-section and which slides back and forth through pillar bushings 1*c* as aforestated.

Figure 3:
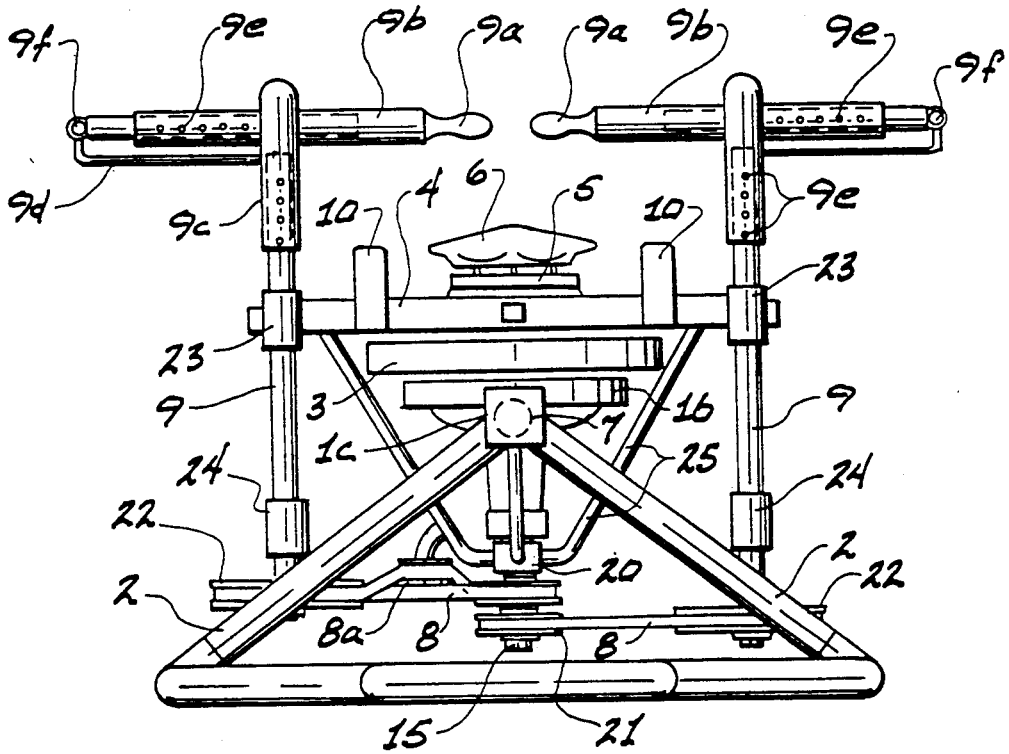
FIG. 3 is an end elevation view of the exercise device of FIG. 1.

The user of the exercise device simply sits upon seat 6, extends his legs so that his feet come in contact with foot rests 10 and then he starts to exercise by pulling upon handles 9*a* of oar members 9. As shown in FIGS. 2 and 3, when the exerciser pulls upon the handles, this causes the vertical portion 9*c* of the oars to rotate causing pulleys 22 to rotate in the bottom portion of the exercise device. These pulleys are connected by V-belts or cables 8 to other pulleys 21 below the flywheel 3, of the exercise device, thus causing the flywheel to rotate.

When the person using the exercise device pulls on the oars, and simultaneously pushes with his feet against foot rest 10 his position upon the floating assembly changes because of his being positioned on seat 6 which slides back and forth in tracks in the surface of the floating assembly 5. The floating assembly also slides back and forth along rod 7 through bearings 1*c* typically a distance of about one foot in a longitudinal direction. The distance that the person slides upon the seat along and atop the floating assembly is also approximately 1 foot. Essentially then what takes place is that the rower goes back and forth upon the floating assembly and the floating assembly itself goes back and forth, thus emulating the movement of what takes place as if the rower were actually in a boat being propelled by the exerciser. It should also be noted that the whole platform 4 and associated connected components is free to be tilted from side to side upon and as it travels back and forth along the rod 7 through bearings 1*c* during the exercise. This, then, simulates the additional feeling of being in a boat and in trying to maintain the boat on an even keel without tipping from side to side.

Other members of the device illustrated in FIGS. 1, 2 and 3 are slanted or diagonal support bracing members 2*a* of the vertical section of the structural support frame, flywheel 3 which is acted upon by V-belts 8, which V-belts are actuated by pulling on the oars by the exerciser. V-belts 8 interconnect regular clutch pulleys 22 beneath the oars and regular pulleys 21 beneath the flywheel. A liftoff pulley 8*a* is also employed so as to take care of the crossing V-belts and prevent them from scraping each other or becoming entangled with each other. Rod 7 is free to move back and forth for a distance of about one foot through pillar bushings 1*c* or floating shaft extension coupling 1*b* at each end of the exercise device (which couplings can be used for multiple coupling of rowing units) and through pillar bushings or bearings 1*c* within the device.

Reference is now made in further detail to FIGS. 2, 3 and 6 to more fully describe the structure of the apparatus and the interrelationships of parts of same. As previously mentioned, the rower sits upon seat 6 which slides along and atop floating assembly 5 upon ball bearings 6*a*. These ball bearings are locked in place beneath the seat by any suitable means. The rower has his legs extended, so that his feet reach foot rests 10, and pulls upon the oar handles 9*a* in order to spin the flywheel 3.

Flywheel 3 is mounted around shaft 15 and rotates around same through bearings 18 and 20. The faster the user of the exercise device pulls on the oars and/or the more vigorously, the faster the flywheel spins, thus tending to help maintain the stability of the exercise device on a horizontal plane and overcome the tendency of the platform to tilt from side to side. Thus, the better the user of the device rows, or the faster, the more able is he to maintain the device on an even plane, simulating similar superior performance by a rower in a boat floating in water.

As previously stated, the device, and/or all of the operational components of same are supported by structural members as 1, 1*a*, 1*b*, 1*c*, 2 and 2*a*: member 1 being the horizontal lower section of the structural support frame; members 1*a* being special "T" couplings at the bottom of the horizontal support frame; members 1*b* being floating shaft extension couplings; members 1*c* being pillar bushings or bearings for supporting rod 7 in the upper horizontal support frame; members 2 being the vertically extending angular sectional members of the structural support frame; and members 2*a* being the slanted or diagonal bracing members of the vertical section of the structural support frame. See FIG. 9 perspective view.

As shown in FIG. 2, the flywheel 3 also has emplaced therein permanent magnets 3*a* which, upon rotation, generate a voltage in a stationary coil pickup member 16 situated beneath flywheel 3 which coil pickup member thus picks up induced voltage from the rotation of the magnets contained in flywheel 3. Voltage-pickup member 16 is coupled to an electrical junction box 26 by means of connector cable 27. This arrangement is thus capable of monitoring, electrically, the efforts exerted by the user of the exercise device, as will hereinafter be further explained.

Oar mechanism 9, illustrated in several of the Figures, consists of a horizontal section 9*b* and a vertical section 9*c*, the length of each of which can be adjusted to suit the size and preference of the individual using the device for maximum comfort and/or efficiency of operation. This is done by means of pegs and holes 9*e* in each of the horizontal and vertical sections of the oar apparatus. Section 9*c* of the oar device rotates within bearings 23 and 24 thus causing rotation of the pulleys 22 which are connected to the shafts or vertical sections 9*c* of the oars; thus, in turn, causing rotation of the flywheel as forced by means of V-belts 8 operating upon pulleys 21, which in turn cause rotation of the shaft 15 which is coupled to the flywheel at its midpoint. Pulleys 22 are one-way pulleys, operatively connected to vertical shaft section 9*c* of oars 9. Pulleys 21 are mounted on shaft 15, thus restricting the rotation of the flywheel to one direction only, either clock-wise or counter-clockwise only, which ever direction may be selected.

With further regard to the flywheel shaft 15, it is surrounded near its top by a self-aligning bearing 18 which allows slight angular displacement from vertical of shaft 15 and the flywheel connected to same as the operator pulls on the oars, as will be discussed later with reference to FIGS. 7*a*, 7*b* and 7*c* of the drawings. The induced voltage coil pickup member 16 also tilts to the same degree as does flywheel 3; however, other than this tilting, member 16 remains stationary, (since it is not mechanically connected to shaft 15 as is the opposite case with flywheel 3) and is not caused to rotate by shaft 15 as is flywheel 3. Coil-pickup member 16 is mechanically supported by vertical support 17 which in turn is coupled to universal joint 19 and to bearing 20 under the universal joint.

Reference to FIG. 3 further assists in explaining the construction and operation of the device. In this view, one can better visualize the user of the apparatus sitting upon seat 6 and pulling oar handles 9*a* toward him and/or pushing them away from him in order to emulate the pulling and pushing of oars as if he were in a boat. The pulling of oar handles 9*a* causes vertical sections 9*c* of the oar devices to rotate, thus causing pulleys 22 to also rotate, thus exerting pulling action upon pulleys 21 and causing shaft 15 connected to flywheel 3 to rotate. When the user of the device pulls on the oar handles 9*a* he slides upon seat 6 upon the seat slide track in the surface of the floating assembly 5, in turn causing platform 4 to move back and forth along circular support rod 7. A setting of pins 9*e* in the holes or slots 9*e* of the oars enables the user of the oars to adjust them for his preferences so as to be closer together at their handle ends or further apart; and also enables the user of the exercise apparatus to vary the distance of the oars above his legs while rowing. The exerciser can also, as desired, pull either oar handle 9*a* separately or pull upon both at the same time.

Figure 4:
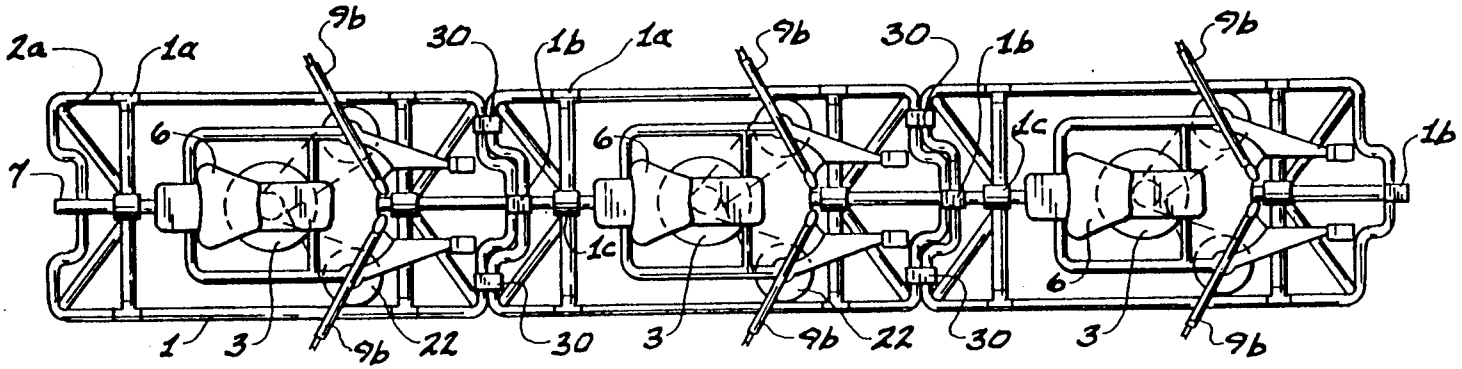
FIG. 4 is a top plan view of the device of FIG. 1, as joined or coupled to two additional devices end to end in a horizontal plane, illustrating how the device can lend itself to group participating exercise.
Figure 5:
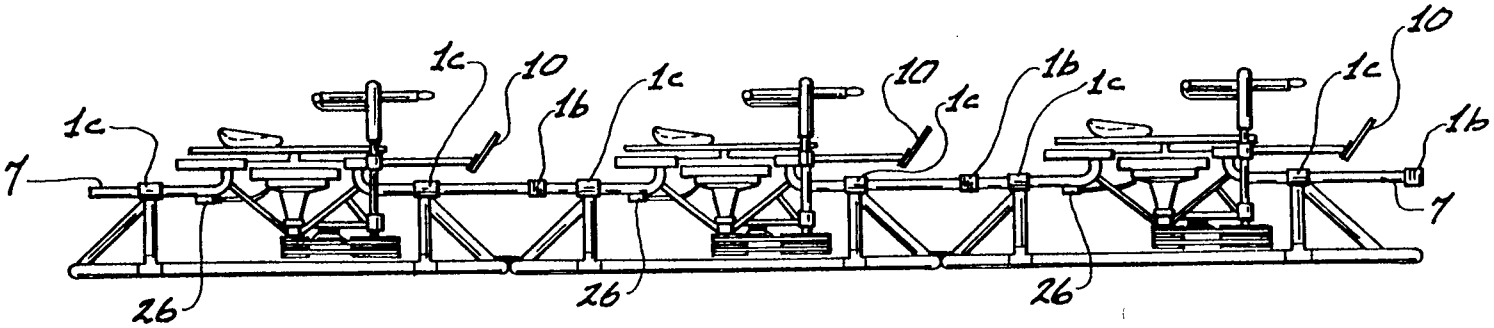
FIG. 5 is a vertical sectional side view of the coupled devices shown in FIG. 4.

The exercise device can of course be used by one person without affecting the correct rotation; or several of the devices can be connected together in order to simulate a rowing crew rowing in competition; and/or to individually assess the performance of each exerciser when two or three or more exercisers operate such connected devices at the same time. Such alternatives are illustrated in FIGS. 4 and 5 wherein three such exercise devices are coupled to each other, end to end, by means of couplings 30, as illustrated in FIG. 4.

Figure 7A:
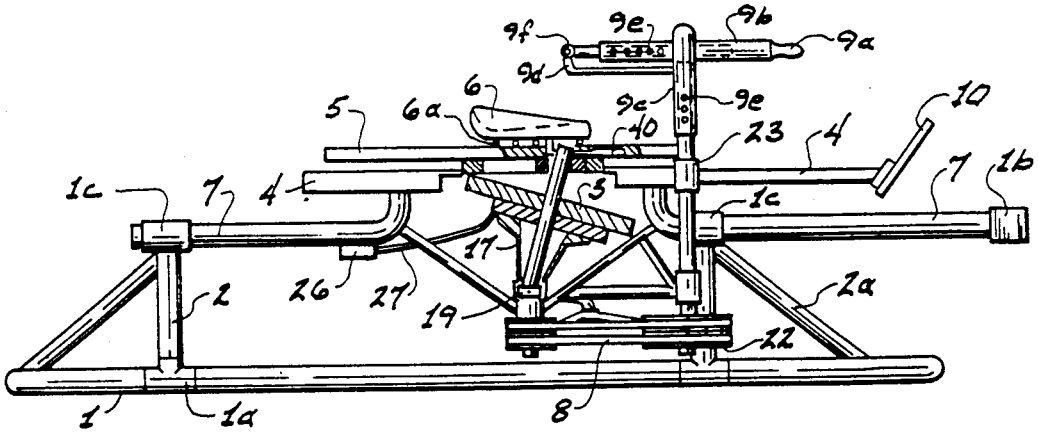
Figure 7B:
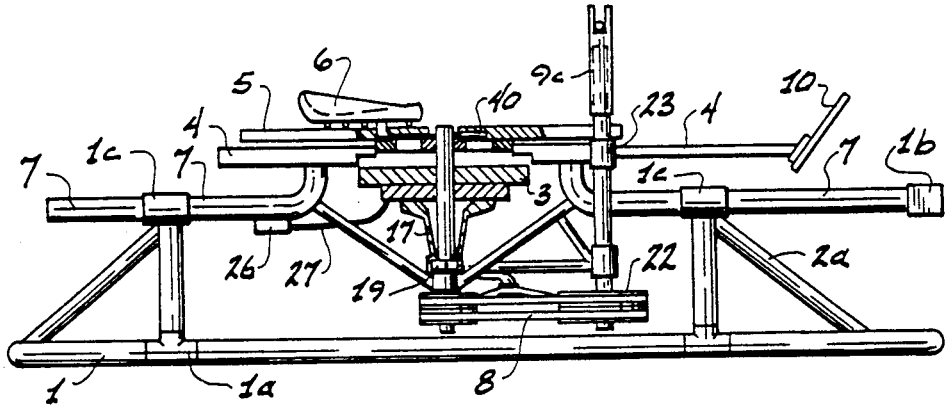
Figure 7C:
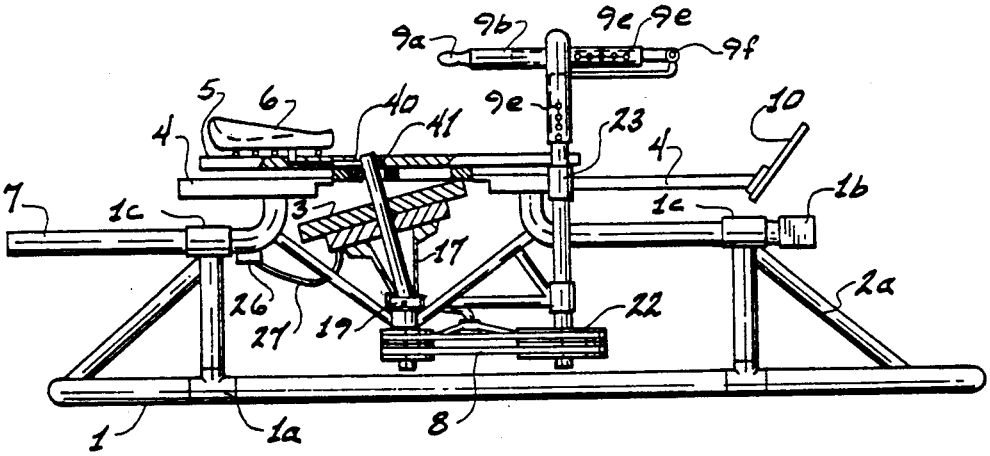

The actions of the gyroscopic rowing machine and the positions of the person using same to exercise are illustrated in FIGS. 7*a*, 7*b* and 7*c*.

When the person initially sits upon seat 6, without starting the rowing exercise, the apparatus and seat are as illustrated in FIG. 7*b*. The seat is near the middle position on the seat slide track of the floating assembly 5, shaft 15 for the flywheel 3 is substantially vertical, the gyroscope is idle, not spinning, and the "boat", i.e. the floating platform 4 is static.

When the exerciser pulls on the oar handles 9*a*, the positions assumed are as illustrated in FIG. 7*a*, i.e. the seat and occupant approach the fully forward position on seat slide track of assembly 5, the angle of shaft 15 approaches 20 degrees forward from vertical, the gyroscope begins to spin, and the "boat"i.e. the floating platform 4 begins movement forward as compared to its initial position in FIG. 7*b*. It, will be noted, however, that the underlying support structure and framing of the device, i.e. members such as 1, 1*a*, 2 and 2*a* etc. remain stationary and do not move.

When the seat and occupant reach the fully forward position depicted in FIG. 7*a*, the exerciser again pulls on oar handles 9*a*, which force, coupled with the weight shift of the exerciser on the device, i.e. his changed center of gravity on the device (and coupled also with the force of bar 40 acting upon shaft 15,) cause a sudden reversal in the positioning of shaft 15 so that it almost instantly changes from about 20 degrees forward of vertical to 20 degrees backward from vertical, as shown in FIG. 7*c*. The exerciser and seat approach fully backward on the floating assembly 5, as bar 40 pulls backward from shaft 15 and the gyroscope continues to spin in the same direction as in FIG. 7*a*, because the one-way clutch pulleys 21 prevent any reverse direction force being exerted on shaft 15 from the forces exerted upon the pulleys 22. The "boat" or floating platform 4 also begins movement backward along with the backward movement of the seat 6 and the floating assembly 5.

As the above described motions continue through their cycles, and the gyroscope reaches optimum speed, i.e. the peak performance of the exerciser using the apparatus, the device and its operation simulate actual floating action and thus add to the user's performance a sense of achievement and accomplishment as well as also merely resulting in a healthy and useful workout or exercise requiring a certain amount of mental alertness.

As previously stated, FIG. 6 is set forth so as to show an enlarged view of several components of the device. This view shows in detail several structural support framing members 25 used to support the moving portions of the exercise device and also for supporting the flywheel 3, the coil pickup member 16 and the universal joint 19 as well as to keep various components of the device in a fixed substantially rigid condition with respect to each other while at the same time permitting the back and forth motion of the seat 6 on slide track of assembly 5 and the side to side motion of the floating platform 4.

The figure also illustrates push rod 40 connected to and under seat 6, which rod is attached to collar 41 over shaft 15. The position of rod 40 in FIG. 6 is the same position as illustrated in FIG. *7b*. When the exerciser pulls on the oars and goes forward on assembly 5 as shown in FIG. *7a*, the "elbow" or left end of the rod under the seat comes in contact with the left side of shaft 15 and assists in pushing it forward of vertical as shown in FIG. *7a*. When the exerciser's position is reversed, as in FIG. *7c*, the right end of the rod, which has a bolt 41 at its end, comes in contact with the right side of shaft 15 and assists in pulling it rearward of vertical to a position as shown in FIG. *7c*. The faster the exerciser rows, the greater will be the speed of the flywheel about axis 15 (thus inducing the greater voltage in coil pickup member 16) and also the more frequent will be the forward and backward movement of shaft 15 from vertical position. A more preferred structural arrangement which is employed to accomplish the foregoing is as illustrated in FIG. 10 which is later discussed.

The electrical circuitry, operatively electrically connected to coil pickup member 16 by means of wires 27, is shown schematically in FIG. 8. Wires 27 are fed to a junction box 26 from which connections can be or are made to lamp 47, volt meter 42, access plug 43, switch 44, resistor 45 and variable resistor 46. Lamp 41 is an indicating light which lights up when the device is being operated and coil pickup member is thus picking up a voltage. Voltmeter 42 is calibrated either in percentage or in voltage output. Access plug 43 can be used to plug in another electrical circuit in order to provide access to other type and/or auxiliary measuring devices or measurements that might be usefully made to monitor the user's performance. On-off Switch 44 is useful to provide for a load increase added to the work to be performed by the user, the load increasing when the switch is open. Resistor 45 has a fixed resistance of whatever ohmage that might be typically useful for the particular user of the device. And variable resistor 46 is useful to enable the user of the device (or a person taking measurements) to vary or control the load against which the user of the device works.

Without being bound in any way be specifying how many magnets *3a* are or might be used in flywheel 3 and/or the number of coil turns in coil pickup member 16 and/or the resistances used in resistors 45 and 46, it can be appreciated by one skilled in the art that all of these are variables which can readily be controlled or modified so as to best adapt the exercise device to its particular specific purpose and/or application.

It should also, of course, be readily apparent that the device has several useful and interesting applications for exercise and enjoyment even when no such electrical features of same are employed as are particularly referred to in describing FIGS. 6 and 8. In other words, the placement of magnets *3a* in flywheel 3 and the use of a coil pickup member 16 and the electrical circuitry connected to same are not essential to the device's operation as an exercise device but are considered as useful specific alternative embodiments within the scope and spirit of the invention.

With further reference now to FIG. 9, this is intended merely as a partially complete perspective view of the exercise device and is included in the drawings only to enable the reader to better visualize the interrelationship of the various structural and movable parts of the apparatus and not to anyway limit it or to be considered the equivalent of engineering drawings, it being deemed obvious that alternative arrangements from the figure as depicted can be made that are still to be considered within the spirit and scope of the invention.

In FIG. 10, seat 6 is supported on spherical bearings or wheels *6a* upon which the seat rides in tracks *6f* (see also FIG. 9) in the surface of floating assembly 5. Holder *6d* provides structural means for attaching the spherical bearing assembly to the bottom of the seat and to shaft bearing 18 which possesses an internally self-aligning bearing surface *18a* for *15b* which is a slide fit for shaft 15; this arrangement allows for shaft slippage to compensate and/or adjust for the back and forth motion of the gyro flywheel 3 as the seat 6 moves back and forth upon the surface of the floating assembly 5. Bolts *6e* provide for attaching the spherical bearing holder *6d* under the base of the seat.

SUMMARY OF PRODUCT USAGE, BENEFITS AND ADVANTAGES

The rowing type exercise apparatus of the present invention utilizes the centrifugal force provided by a gyroscopic wheel rotating about a vertical axis. The force of the gyroscopic wheel is provided by the rowing or pulling action of the individual using the apparatus; by virtue of his/her manually synchronized pulling action on the oars or other pulling means which are operatively connected to the gyroscopic wheel.

The whole rowing apparatus, together with sliding seat, is on one laterally pivotable frame that is held on a center-line horizontal axis, and which frame has a limited motion, back and forth, along the horizontal axis. The resultant effect of these features is that the rotation of the gyroscopic wheel "attempts" to maintain the floating frame on a level keel parallel to the ground plane, while, on the other hand, the floating frame gives the user of the apparatus the feeling of horizontal motion.

Features or uses or benefits that make the rowing apparatus of this invention unique and appealing are:

a. For health and physical purposes, the apparatus serves a dual purpose—(i) physical exercise; and (ii) mental exercise:

(i) By rowing, the operator is exercising his body to maintain the rotation of the gyroscope wheel;

(ii) In order to maintain horizontal stability and level action, the operator must continually keep rowing at the same time as controlling his working action in order to achieve and maintain the desired horizontal stability of the top movable platform; this is an added feature which requires a concurrent ongoing mental attitude.

(iii) The person using this exercising apparatus will get the sensation of floating similar to rowing in a boat. This will give him more incentive to keep working on his exercising to maintain seated stability, thus providing better exercise benefit because of the added incentive.

(iv) Because of the unique flexible features of the apparatus, there is a tendency for the exerciser to work differently, harder and longer, thus providing more body health benefits; i.e. takes away the boring attitude of using other previous types of rowing exercise apparatuses and adding immeasurably to maintain working on the apparatus, and wanting to return to use it again.

Some added features and capabilities of the machine are:

1. The rowing apparatus lends itself to group participating exercise because of the horizontal "Back and Forth" motion along a horizontal plane, e.g. by simple coupling end to end of two or more machines.
2. Placed individually with more than one device, then a competition type of exercise can be formed, e.g. with ergomatic totalling type of apparatus on each machine, the capability of individuals can be assessed.
3. There are many more arrangements that can be incorporated with apparatus for "Amateur People" and for "Professional People", particularly the rowing fraternity.

In sum, the apparatus of this invention can be designed and the components so arranged as to be usable by three main different categories of people or uses.

a. general, non-professional people (the public) looking for exercise;
b. amateur and professional people in the sport fraternity; and
c. for medical, clinical, health and analytical testing use.

While the present invention has been described and illustrated in detail, various modifications may be made by those skilled in the art. It is therefore to be understood that the invention is not to be limited to the details of construction described and illustrated and it is intended by the appended claims to cover all modifications which fall within the spirit and scope of the invention.

I claim:

1. A rowing type exercise apparatus, said apparatus capable of emulating the actual sensations of rowing, including the sensation of tippiness at slow rowing speeds and of also providing an artificially induced sense of motion to the rower of the apparatus at the end of each rowing stroke, said apparatus comprising:

a. a horizontal and vertical structural support frame;
b. a laterally pivotable horizontal platform, gyroscopically stabilized;
c. a horizontal gyroscopic flywheel shaped member operatively connected to the horizontal platform for rotation about a substantially vertical axis in a portion of the structural support frame to stabilize the platform; and
d. a floating assembly coupled to the horizontal platform by attachment means for sliding longitudinally back and forth atop said horizontal platform, said floating assembly and said horizontal platform coupled to a rod member means for sliding back and forth through pillar bushings in said support frame as the rower operates oars, which are pivotally connected to said horizontal platform, by exerting force upon an arrangement of belts and pulleys operatively connected to said gyroscopic flywheel shaped member to provide rotational energy to said apparatus.

2. A rowing exercise apparatus according to claim 1 wherein the gyroscopic flywheel shaped member contains permanent magnets and the gyroscopic flywheel shaped member rotates in an area of the apparatus containing field coils, whereby a voltage is induced by rotation of the gyroscopic flywheel shaped member.

3. A rowing exercise apparatus according to claim 1 wherein said apparatus is one of a plurality of similar rowing apparatus horizontally coupled to each other, end to end, by floating shaft extension couplings at each end of each individual rowing exercise apparatus, thus providing a multiple rowing arrangement whereby at least two rowers can participate at the same time.

4. A rowing exercise apparatus according to claim 1 wherein the gyroscopic flywheel shaped member is mounted around a shaft and rotates around said shaft through the use of bearings and wherein a self-aligning bearing is coupled on said shaft atop of the gyroscopic flywheel shaped member which allows slight angular displacement from the vertical axis of the shaft.

5. A rowing exercise apparatus according to claim 1 further including oars possess means which enable the rower to adjust a preferred position of the handles of said oars.

6. A rowing type exercise apparatus, said apparatus capable of emulating the actual sensations of rowing, including the sensation of tippiness at slow rowing speeds and of also providing an artificially induced sense of motion to the rower of the apparatus at the end of each rowing stroke, said apparatus comprising:

a. a horizontal and vertical structural support frame;
b. a laterally pivotable horizontal platform, gyroscopically stabilized;
c. a horizontal gyroscopic flywheel shaped member operatively connected to the horizontal platform for rotation about a substantially vertical axis in a portion of the structural support frame to stabilize the platform;
d. a floating assembly coupled to the horizontal platform by attachment means for sliding longitudinally back and forth atop said horizontal platform, said floating assembly and said horizontal platform coupled to a rod member means for sliding back and forth through pillar bushings in said support frame; and
e. a slidable rowing seat mounted atop the floating assembly, whereby the rower positions himself upon the floating assembly and enables himself to emulate the actual sensations of rowing by rowing oars, which are pivotally connected to said horizontal platform, to exert force upon an arrangement of belts and pulleys operatively connected to said gyroscopic flywheel shaped member to provide rotational energy to said apparatus.

7. A rowing exercise apparatus according to claim 6 wherein the gyroscopic flywheel shaped member contains permanent magnets and the gyroscopic flywheel shaped member rotates in an area of the apparatus containing field coils, whereby a voltage is induced by rotation of the gyroscopic flywheel shaped member.

8. A rowing exercise apparatus according to claim 6 wherein said apparatus is one of a plurality of similar rowing apparatus horizontally coupled to each other, end to end, by floating shaft extension couplings at each end of each individual rowing exercise apparatus, thus providing a multiple rowing arrangement whereby at least two rowers can participate at the same time.

9. A rowing exercise apparatus according to claim 6 wherein the gyroscopic flywheel shaped member is mounted around a shaft and rotates around said shaft through the use of bearings and wherein a self-aligning bearing is coupled on said shaft atop of the gyroscopic flywheel shaped member which allows slight angular displacement from the vertical axis of the shaft.

10. A rowing exercise apparatus according to claim 6 further includes oars possess means which enable the rower to adjust a preferred position of the handles of said oars.

* * * * *